US011650031B2

(12) United States Patent
Galloway et al.

(10) Patent No.: US 11,650,031 B2
(45) Date of Patent: May 16, 2023

(54) SHAPED CHARGE DEVICES, SYSTEMS, AND RELATED METHODS OF USE

(71) Applicants: Vanderbilt University, Nashville, TN (US); The United States of America as Represented by the Secretary of the Army, Washington, DC (US)

(72) Inventors: Kevin C. Galloway, Nashville, TN (US); Kelsay E. Neely, Nashville, TN (US); Aimee J. Valles, Nashville, TN (US); Robert J. Clark, Nashville, TN (US); Jesse L. Frederick, Nashville, TN (US)

(73) Assignees: Vanderbilt University, Nashville, TN (US); The United States of America as Represented by the Secretary of the Army, Washington, DC (US)

( * ) Notice: Subject to any disclaimer, the term of this patent is extended or adjusted under 35 U.S.C. 154(b) by 203 days.

(21) Appl. No.: 16/987,933

(22) Filed: Aug. 7, 2020

(65) Prior Publication Data

US 2021/0302134 A1 Sep. 30, 2021

Related U.S. Application Data

(60) Provisional application No. 62/883,874, filed on Aug. 7, 2019.

(51) Int. Cl.

| | |
|---|---|
| ***F42B 1/028*** | (2006.01) |
| ***F42B 1/036*** | (2006.01) |
| ***F42B 3/08*** | (2006.01) |

(52) U.S. Cl.
CPC ..... *F42B 1/028* (2013.01); *F42B 1/036* (2013.01); *F42B 3/08* (2013.01)

(58) Field of Classification Search
CPC .... F42B 1/00; F42B 1/02; F42B 1/028; F42B 1/036; F42B 3/08; F42B 12/10
USPC ..... 102/306, 307, 331
See application file for complete search history.

(56) References Cited

U.S. PATENT DOCUMENTS

| | | | | | |
|---|---|---|---|---|---|
| 1,464,866 | A * | 8/1923 | Georges | F42B 3/087 | 102/331 |
| 3,207,072 | A * | 9/1965 | Holden | F42B 3/08 | 102/310 |
| 4,344,646 | A * | 8/1982 | Michel | E05B 65/5276 | 292/87 |
| 4,974,516 | A * | 12/1990 | Eyal | F42B 12/10 | 102/491 |
| H866 | H * | 1/1991 | Faccini | 102/307 | |
| 5,223,666 | A * | 6/1993 | Delaney, Jr. | F41H 11/12 | 102/306 |

(Continued)

*Primary Examiner* — James S Bergin
(74) *Attorney, Agent, or Firm* — Meunier Carlin & Curfman LLC

(57) ABSTRACT

Shaped charge devices, systems, and related methods of use. A housing sheet is configurable to form at least part of a shaped charge enclosure enclosing a shaped charge and biasing an explosion in a desired direction. The housing sheet can include one or more incisions in at least one surface thereof. The housing sheet can have at least one connection mechanism integrally formed therein, and the housing sheet can be configurable to form a plurality of sizes of shaped charge housing portions. The housing sheet can also provide for forming a plurality of dimensions of the shaped charge enclosure.

26 Claims, 10 Drawing Sheets

(56) References Cited

U.S. PATENT DOCUMENTS

| | | | | |
|---|---|---|---|---|
| 5,351,622 | A * | 10/1994 | Ekholm | F42B 1/02 102/306 |
| 7,963,131 | B2 * | 6/2011 | Zhang | E05B 73/0023 70/57.1 |
| 9,074,855 | B1 * | 7/2015 | Frericks | F42B 1/02 |
| 9,303,961 | B1 * | 4/2016 | Frericks | F42B 1/032 |
| 9,441,924 | B1 * | 9/2016 | Frericks | F42B 1/028 |
| 10,222,182 | B1 * | 3/2019 | Cardoza | F42B 1/02 |
| 10,683,735 | B1 * | 6/2020 | McCarthy | F42B 1/028 |
| 11,346,191 | B2 * | 5/2022 | Sokolove | E21B 43/263 |

* cited by examiner

SHAPED CHARGE DEVICES, SYSTEMS, AND RELATED METHODS OF USE

CROSS-REFERENCE TO RELATED APPLICATION

This application claims priority to, and benefit under 35 U.S.C. § 119(e) of, U.S. Provisional Patent Application No. 62/883,874, filed Aug. 7, 2019, which is hereby incorporated by reference herein in its entirety.

BACKGROUND

A shaped charge is an explosive charge shaped to focus the effect of the explosive's energy. Various types of shaped charges can cut and form metal, penetrate armor, and remove earth for the oil and gas industry. The basic components of a shaped charge are the case (or enclosure), the explosive material, and the liner. In military applications, many shaped charges come in kits with enclosures of various sizes (small, medium, large), shapes (rectangular box-like or cylindrical), and materials (metal or plastic). For example, a kit may have 8 small, 5 medium, and 2 large shaped charges. Some common models are the linear shaped charge, which has a rectangular prism shape enclosure, and the explosively formed projective (EFP), which has a cylindrical shape enclosure. These are typically formed from rigid injection molded plastic or formed metal.

These kits and enclosures present several challenges for operators in austere environments such as in military operations where one is limited by the equipment on hand and at times unreliable supply chains. One challenge is that the enclosures are a one-time use. Once the shaped charge is detonated, the enclosure disintegrates. This can bring about scenarios where a desired size in a kit might run out, thereby forcing an operator to open up another kit, if available (at a potential cost of thousands of dollars) and/or to try to make due with any remaining shaped charges (which may not be ideal for a particular task at hand). Such scenarios can thus place military personnel in a compromised position. Another challenge with conventional enclosures is that larger models can be relatively heavy (on the order of kilograms), thereby placing an added burden on the operator (who may be required to transport it on foot over large distances). It is with respect to these and other considerations that the various implementations described below are presented.

SUMMARY

Some aspects of the present disclosure relate to a device. In some implementations, a device includes a housing sheet that is configurable to form at least part of a shaped charge enclosure. The shaped charge enclosure encloses a shaped charge. The device is formed to bias an explosion in a desired direction. The housing sheet includes one or more incisions in at least one surface thereof. The housing sheet has at least one connection mechanism integrally formed therein. The housing sheet is configurable to form a plurality of sizes of shaped charge housing portions and provides for forming a plurality of dimensions of the shaped charge enclosure.

Some aspects of the present disclosure relate to a shaped charge system. In some implementations, the shaped charge system includes the device described above and also an explosive disposed inside the enclosure of the shaped charge. The system also includes a shaped charge liner coupled to at least one shaped charge housing sheet.

Some aspects of the present disclosure relate to a method of assembling a shaped charge enclosure. In some implementations, the method includes manipulating a shaped charge housing sheet to form an enclosure. The method also includes coupling a shaped charge liner to the housing sheet, inserting an explosive into the enclosure, and sealing the enclosure.

Other aspects and features according to the present disclosure will become apparent to those of ordinary skill in the art, upon reviewing the following detailed description in conjunction with the accompanying drawings.

BRIEF DESCRIPTION OF THE DRAWINGS

Reference will now be made to the accompanying drawings, which are not necessarily drawn to scale.

DETAILED DESCRIPTION

Figure 1:
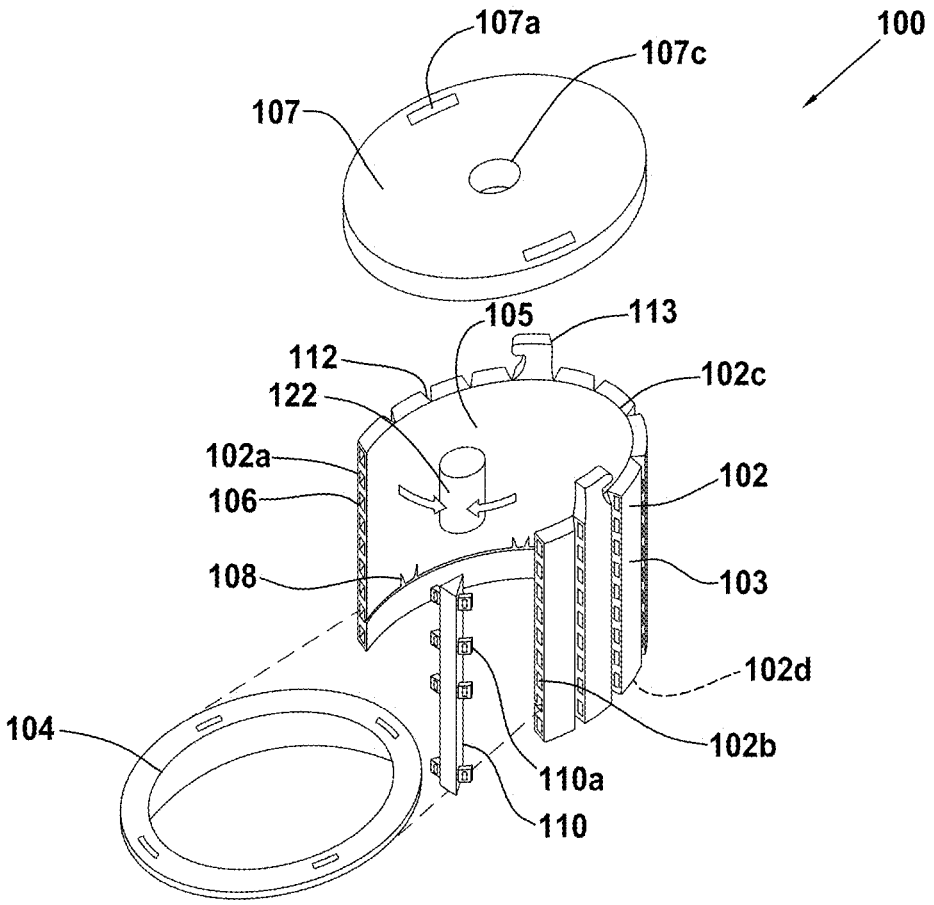
FIG. 1 shows an exploded view of a device according to one example implementation of the present disclosure. The device forms a shaped charge enclosure including a housing sheet, a shaped charge liner, and a lid.

In some aspects, the present disclosure relates to shaped charge devices, systems, and related methods of use. Although example implementations of the present disclosure are explained in detail herein, it is to be understood that other implementations are contemplated. Accordingly, it is not intended that the present disclosure be limited in its scope to the details of construction and arrangement of components set forth in the following description or illustrated in the drawings. The present disclosure is capable of other implementations and of being practiced or carried out in various ways.

It must also be noted that, as used in the specification and the appended claims, the singular forms "a," "an" and "the" include plural referents unless the context clearly dictates otherwise. Certain values may be expressed in terms of ranges "from" one value "to" another value. When a range is expressed in terms of "from" a particular lower value "to" a particular higher value, or "from" a particular higher value "to" a particular lower value, the range includes the particular lower value and the particular higher value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example implementations, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more steps of a method does not preclude the presence of additional method steps or intervening method steps between those steps expressly identified. Steps of a method may be performed in a different order than those described herein without departing from the scope of the present disclosure. Similarly, it is also to be understood that the mention of one or more components in a device or system does not preclude the presence of additional components or intervening components between those components expressly identified.

Some aspects of the present disclosure relate to a shaped charge enclosure system. In some implementations, the shaped charge enclosure system is configurable to form shaped charged enclosures having a plurality of shapes and sizes. The shaped charge enclosure can be formed from a housing sheet which can be bent into an enclosure. The shaped charge enclosure can also be formed from a housing sheet which is separable into separate components to be reassembled into an enclosure, allowing a user of a shaped charge to carry a single housing sheet to form a plurality of enclosure sizes to fit a desired shape or size shaped charge application. Accordingly, devices and/or systems according to some implementations can eliminate wasted components in shaped charge enclosure kits.

Among other benefits and advantages, the present disclosure in some implementations presents a rapidly customizable enclosure that enables an operator to select the size and shape from specially perforated sheet materials. For example, a single sheet may contain enough material to make one large shaped charge; however, this same material may be used to assemble two medium or four small shaped charges or combinations thereof. Thus, the specially perforated sheets enable a wider set of enclosure size, shape, and material combinations that can be selected as needed.

A detailed description of certain aspects of the present disclosure, in accordance with various example implementations, will now be provided with reference to the accompanying drawings. The drawings form a part hereof and show, by way of illustration, specific implementations and examples. In referring to the drawings, like numerals represent like elements throughout the several figures.

Figure 2:
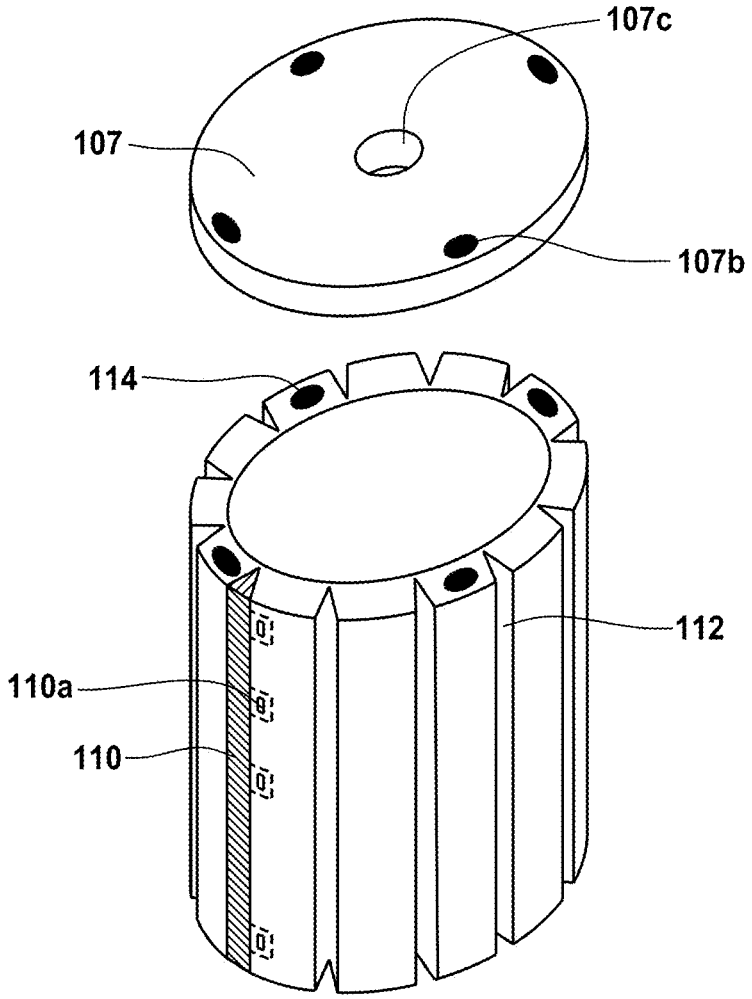
FIG. 2 shows a partially exploded view of the device as shown in FIG. 1, with the housing sheet, the lid, and a joinery.
Figure 3:
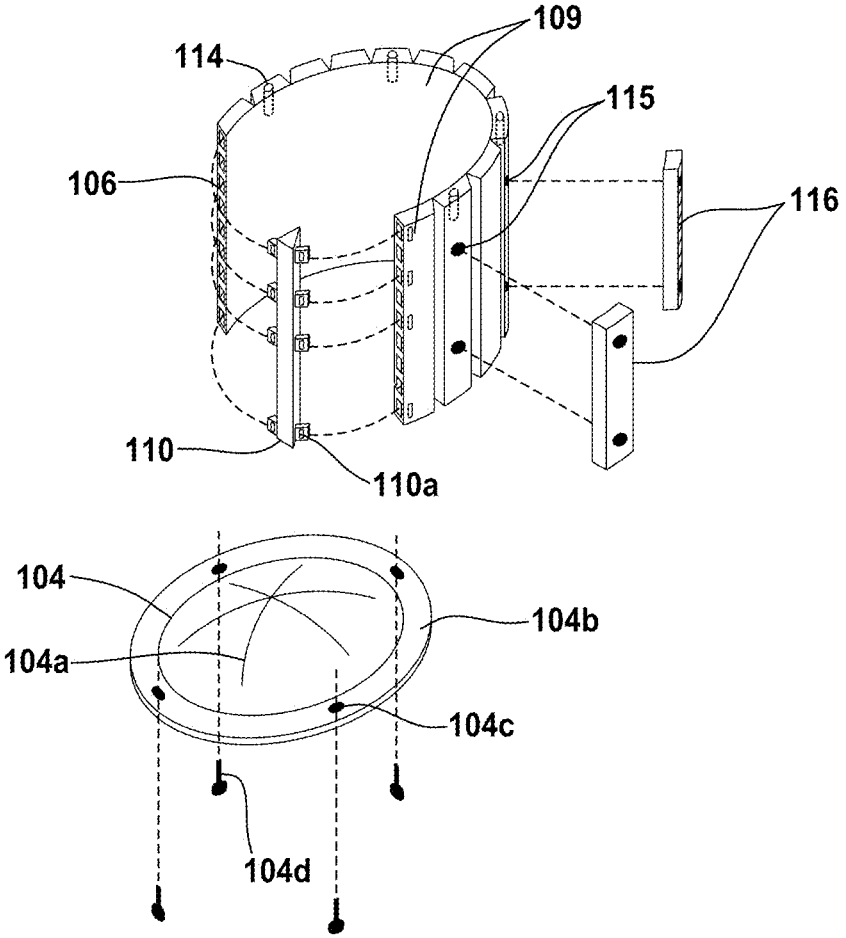
FIG. 3 shows an exploded view of a device including a housing sheet, a shaped charge liner, a lid, a joinery, and auxiliary attachments.

FIGS. 1-3 show a system 100 according to one implementation. The system 100 includes a housing sheet 102, a shaped charge liner 104, a lid 107, an explosive 122, and a joinery 110. The kit includes components sufficient to assemble shaped charges of multiple sizes to conform to situational requirements of various shaped explosive applications. In the implementation shown in FIG. 1, the housing sheet 102 is a plastic rectangular sheet with a first surface 103 and a second surface 105 that is opposite and spaced apart from the first surface 103. The housing sheet 102 has a first side 102*a* and a second side 102*b* opposite and spaced apart from the first side 102*a*. The housing sheet 102 has a third side 102*c*, and a fourth side 102*d* opposite and spaced apart from the third side 102*c*. The first side 102*a* and the second side 102*b* are perpendicular to the third side 102*c* and the fourth side 102*d* of the housing sheet 102, forming a rectangular shape.

The housing sheet 102 includes corrugation flutes 106 as shown in FIGS. 1-6, which are disposed in the thickness of the housing sheet 102. The corrugation flutes 106 are cuboid channels that which axially extend between the third side 102*c* and the fourth side 102*d* of the housing sheet 102. Each corrugation flute 106 has a width, which extends parallel to the third side 102*c* and the fourth side 102*d* of the housing sheet 102. Each corrugation flute 106 also has a thickness, which is the distance that the corrugation flute 106 spans between the first side 104 and the second side 104 of the housing sheet 102. In one implementation, the width of each corrugation flute 106 is 0.4 inches and the thickness of each corrugation flute 106 is 0.35 inches. The corrugation flutes 106 are abutting each other such that a longitudinal axis of each corrugation flute 106 is parallel to the longitudinal axis of each of the other corrugation flutes 106. The housing sheet 102 also has slits 112 in the first surface 103 of the housing sheet 102. The slits 112 pass partially through the thickness of the housing sheet 102. The slits 112 extend between the third side 102*a* and the second side 102*b* of the housing sheet 102. The slits 112 are parallel with the longitudinal axes of the corrugation flutes 106. The slits 112 are formed to promote bending of the housing sheet 102 into a curved shape such as a cylinder as shown in FIGS. 1-4 and 6. Each slit 112 is spaced apart from adjacent slits 112 by 1 inch. The housing sheet 102 includes an incision 108 disposed on the second surface 105 of the housing sheet 102 which extends between the first end 102*a* and the second end 102*b*. The incision 108 is parallel with the first side 102*a* and the second side 102*b* of the housing sheet 102. In one implementation, the incision 108 is disposed 0.65 inches from the fourth surface 102*d* of the housing sheet 102, which is at a center line of a second corrugation flute 106) from the fourth surface 102*d* of the housing sheet 102. The housing sheet 102 has a plurality of locking notches 109 disposed in the first surface 103. The locking notches 109 are formed to couple to the joinery 110. The locking notches 109 are small incisions which extend axially on segments of the housing sheet 102 directly adjacent to the first side 102*a* and the second side 102*b* of the housing sheet 102.

As shown in FIG. 1, the housing sheet 102 has connection elements to couple a lid 107 to the third end 102*c* of the housing sheet 102 to form an enclosure. FIG. 1 shows a plurality of hooks 113 which extend away from the third end 102*c* of the housing sheet 102. The hooks 113 are formed to engage with fastening slots 107*a* in the lid 107. FIGS. 2-3 show fastening holes 114, which are disposed in the third end 102*c* of the housing sheet 102. The fastening holes 114 are formed to receive bolts or screws for coupling lids.

Although in the implementation shown in FIGS. 1-6, the corrugation flutes 106 are cuboid channels, in some implementations, the corrugation flutes are cylindrical channels, or channels of any other shape suitable to provide flexibility to a plastic sheet, which is to be formed into a cylinder. The corrugation flutes 106 can have a width between 0.01-1 inches, a thickness between 0.01-1 inches, or any other width and/or thickness suitable to provide flexibility to a plastic sheet. The corrugation flutes 106 in the implementations shown in FIGS. 1-6 have a width of 0.4 inches and a thickness of 0.35 inches. The slits 112 can be spaced apart by a distance between 0.01-10 inches or any other distance suitable to provide flexibility to a plastic sheet which is to be formed into a cylinder. In the implementation shown in FIGS. 1-6, each slit 112 is spaced apart from adjacent slits 112 by 1 inch. The housing sheet 102 shown in FIGS. 1-6 is formed from plastic. But in other implementations, the housing sheet 102 can be formed from polyurethane, a layered metal and corrugated plastic, or any other material which is flexible and suitable for directing a shaped charge explosion in a desired direction.

Figure 6B:
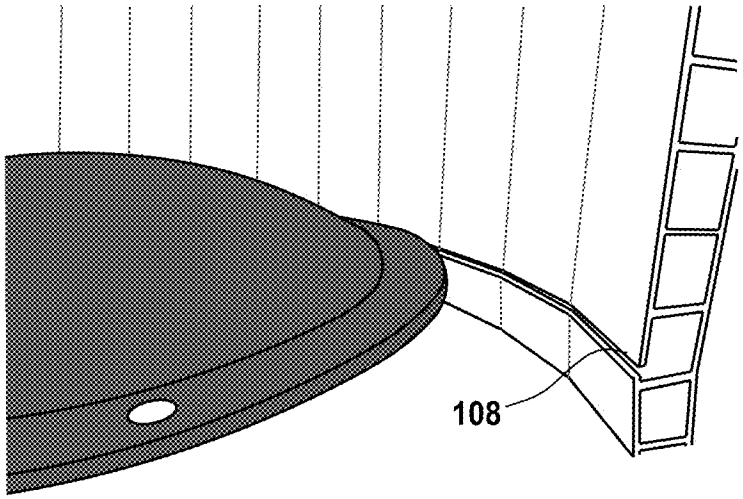
FIG. 6B shows a perspective view of the housing sheet coupled to the liner coupled to a circumferential incision of the housing sheet.
Figure 6C:
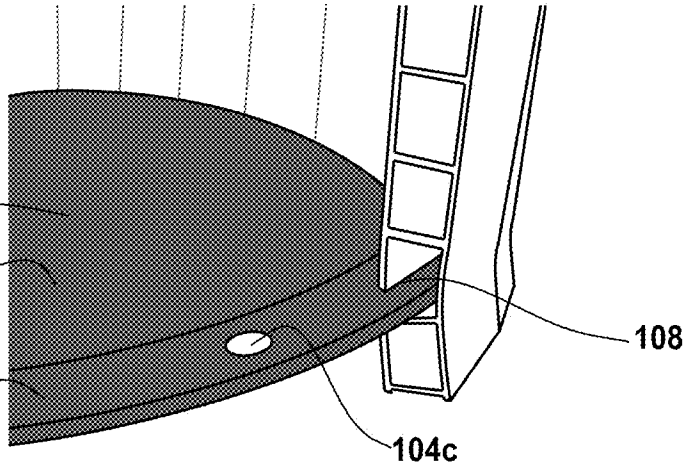
FIG. 6C shows a detailed view of the liner coupled to a circumferential incision of the housing sheet.
Figure 6A:
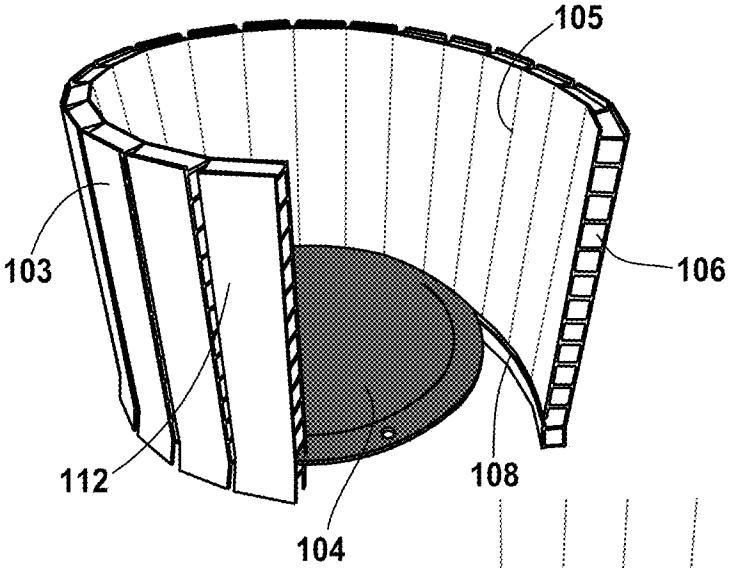
FIG. 6A shows a perspective view of a housing sheet coupled to a shaped charge liner.

As shown, the shaped charge liner 104 is a concave plate, which is formed to deform into a projectile upon detonation of the shaped charge. In the implementation shown in FIGS. 1-6, the shaped charge liner 104 is a disk-shaped plate which has a concaved plate surface 104*a* a coupling diameter 104*b*, and liner holes 104*c*. The coupling diameter 104*b* surrounds the plate surface and provides a coupling interface to couple to the incision 105 in the plate as shown in FIGS. 1 and 6. The coupling diameter 104*b* also provides a flat surface to abut an end of a shaped charge enclosure. The liner holes 104*c* are formed to receive to a fastening mechanism such as liner bolts 104*d* such as in the implementation of FIG. 3. The shaped charge liner 104 can have a diameter between 0.1-24 inches or any other diameter suitable for a circular shaped charge liner. The shaped charge liner 104 shown in FIGS. 1-6 has a diameter of 6 inches.

The joinery 110 is a rod having a plurality of pairs of connection tabs 110*a* disposed along a length of the joinery 110. The pairs of connection tabs 110*a* form a 160-degree angle with respect to each other. The connection tabs 110*a* each have locking surfaces (not shown) that protrude perpendicular to the direction the tab extends. The locking surfaces are configured to engage with the locking notches 109 in the first surface 103 of the housing sheet 102. According to the implementation of FIG. 4, a joinery can also be a joinery insert 118, which is a pair of connection tabs 118*a* not connected to a rod. A plurality of joinery inserts 118 are placed into the corrugation flutes and engaged with the locking notches 109 as described above.

Although the implementations described above use locking notches 109 to secure the housing sheet 102 in a desired shape, in other implementations, the connection tabs are sized to form a friction fit that holds the housing sheet 102 in a desired shape. Although the pairs of connection tabs are disposed at a 160-degree angle with respect to each other as shown in FIGS. 2-3, in other implementations the connection tabs are disposed at a 140-degree angle, a 170-degree angle, or any other angle suitable to join ends of a planar sheet to form a cylinder. Although the connection tabs 110*a* are disposed in pairs as shown in FIGS. 2-3, in other implementations the tabs are not disposed in pairs but are disposed in non-uniform configurations along the length of the joinery 110. Although a joinery 110 is used in the implementations shown in FIGS. 1-3, in other implementations, cable ties 111 are used to hold the housing sheet 102 in cylindrical shape.

The lid 107 is a disk-shaped plate which has fastening mechanisms disposed therein. The fastening mechanism in the implementations shown in FIG. 1 is a lid slot 107*a*. The fastening mechanism shown in the implementation of FIG. 2 is a lid hole 107*b*. The lid 107 is formed to contain the explosive 122 when inserted inside the shaped charge enclosure. The lid 107 also serves as an insertion and anchoring point for a detonator (not shown). The lid includes a detonator hole 107*c* disposed in the center of the lid 107. The detonator hole 107*c* passes from an outer atmosphere into the enclosure and provides a passage for a detonator to pass into the enclosure. The lid 107 is formed from plastic, but in other implementations the lid 107 can be formed from metal, composites, or rubber. In one implementation, the lid 107 has a diameter of 8.6 inches. The explosive 122 is C-4 as shown in the implementation of FIG. 1. But, in other implementations, the explosive 122 is TNT, a polymer-bonded explosive, or another explosive having a high detonation velocity and pressure wave.

The system 100 as shown in FIG. 3 also includes auxiliary coupling holes 115 and auxiliary attachments 116. The auxiliary coupling holes 115 are disposed in the first surface 103 of the housing sheet 102. The auxiliary coupling holes 115 extend a depth into the thickness of the housing sheet 102. The auxiliary coupling holes 115 as shown in FIG. 3 are threaded to accept bolts. But in other implementations, the auxiliary coupling holes 115 are non-threaded through-holes and formed to accept screws, bolts secured by nuts, or any other fastener suitable to attach an auxiliary attachment 116 to a housing sheet. The auxiliary attachments 116 shown in FIG. 3 are tripod mounting attachments to position a shaped charge at a desired distance and orientation from a surface. But in other implementations, the auxiliary attachments 116 can be stands or any other attachment suitable for coupling to a shaped charge surface.

Figure 4:
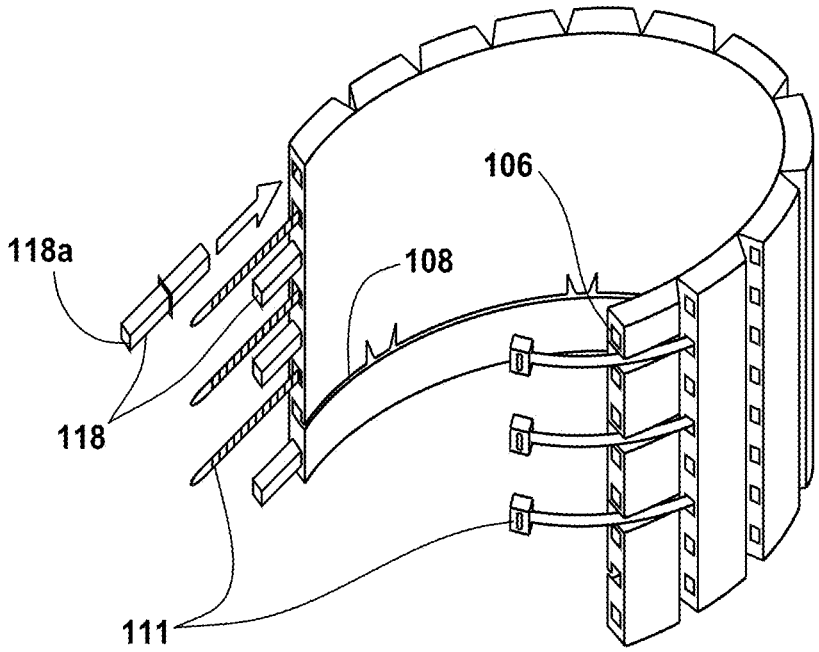
FIG. 4 shows an exploded view of a device including a housing sheet, a joinery insert, and cable ties.
Figure 5A:
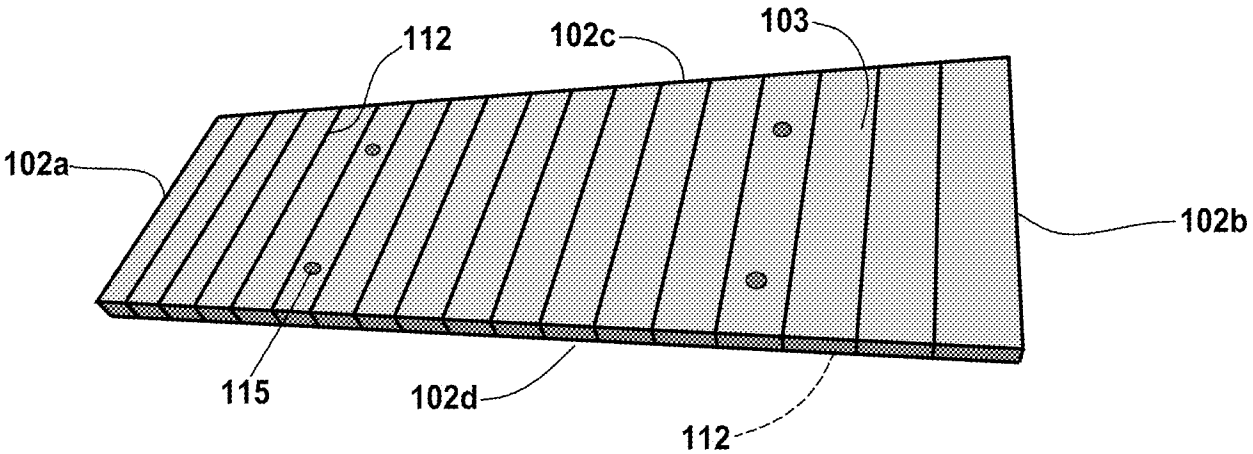
FIG. 5A shows a perspective view of a housing sheet used in some implementations.
Figure 5B:
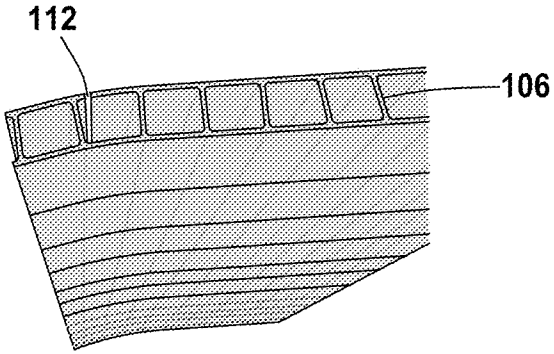
FIG. 5B shows a detailed view of the housing sheet of FIG. 5B, illustrating corrugation flutes.

As shown in the implementations of FIGS. 1-4, the housing sheet 102 is formed into a cylindrical enclosure where the first side 102*a* and the second side 102*b* abut each other. The first side 102*a* and the second side 102*b* of the housing sheet 102 are joined together by the joinery 110 which engages the locking notches 109 as shown in FIGS. 2-3, forming a hollow cylinder. In other implementations as shown in FIG. 4 the housing sheet 102 can be joined together by a plurality of cable ties 111 and joinery inserts 118. The cable ties 111 are extended around the circumference of the enclosure and extend through the corrugation flutes 106. The cable ties 111 are self-locked to secure the housing sheet 102 into a cylindrical shape. The explosive 122 is placed inside the enclosure and the liner 104 is engaged with the housing sheet 102.

As shown in FIG. 1, the liner 104 is coupled to the housing sheet 102 by inserting the coupling diameter 104*b* of the liner 104 to the incision 108 of the housing sheet 102 by securing the coupling diameter 104*b* into the incision 108 before fastening the housing sheet 102 around it. But, in other implementations as shown in FIG. 3, the liner 104 is coupled to the housing sheet 102 by bolts. The lid 107 is placed on the third end 102*c* of the housing sheet 102 and coupled thereto. In the implementation shown in FIG. 1, the lid 107 is fastened to the housing sheet 102 by engaging the hooks 113 on the housing sheet 102 with the slots in the lid 107. But in other implementations, as shown in FIG. 2, the lid 107 is coupled to the housing sheet 102 by a set of bolts 104 that pass though the lid hole 107*b* of the lid 107 and the fastening hole 114 of the housing sheet 102 on the third end 102*c* of the housing sheet 102. In the implementation shown in FIG. 4, the cable ties 111 are extended around the circumference of the enclosure and through the corrugation flutes 106. But in other implementations, the cable ties 111 are disposed on the first surface 103 of the housing sheet 102, encircling the housing sheet 102.

FIGS. 7-10 show the shaped charge system 700 according to another implementation. FIGS. 7-10 show a linear implementation of the shaped charge system 700. The shaped charge system 700 as shown in FIGS. 7-10 includes a housing sheet 702 and a liner 704. The housing sheet 702 is a modular housing sheet. The modular housing sheet 702 is formed to be separated and reassembled into a shaped charge enclosure. The housing sheet 702 has a first side 701, a second side 703 which is opposite and spaced apart from the first side 701. The housing sheet 702 has a first section 706, a second section 708, and a lid section 707. The first section 706 has a first end 706*a*, a second end 706*b* opposite and spaced apart from the first end 706*a*, a third end 706*c*, and a fourth end 706*d* which is opposite and spaced apart from the third end 706*c*. The first section 706 also has a center line 706*e*, which is perforated with perforations 706*f*. The first section 706 has two hexagon openings 710*a-b* disposed in the surface and extending between the first side 701 and the second side 703 of the first section 706 of the housing sheet 702. The hexagon openings 710*a-b* are positioned such that the center line 706*e* of the first side 701 of the housing sheet 702 passes through two vertexes of each of the hexagon openings 710*a-b*.

The first side 702*a* and the second side 702*b* each have two L-shaped hooks 714 extending therefrom. The hooks 714 are spaced apart along the first end 706*a* and the second end 706*b* of the of the first section 706. The hooks 714 each extend outward and away from the rest of the first section and curve toward the plane of the second end 706*b* of the first section 706. The third end 706*c* and the fourth end 706*d* each have four L-shaped side hooks 715 extending therefrom. The side hooks 715 are spaced apart along the third end 706*c* and the fourth end 706*d* of the of the first section 706. The hooks 714 each extend outward and away from the rest of the first section 706 and curve toward the center line 706*e* of the first section 706. The second section 708 includes has a first side 708, a second side 708*b* opposite and spaced apart from the first side 708*a*, a third side 708*c*, and a fourth side 708*d* which is opposite and spaced apart from the third side 708*c*. The second section 708 also has a center line 708*e*, which is perforated. The second section 708 has a plurality of hook slots 716, which extend between the first side and the second side of the second section 708. The second section 708 has eight hook slots 716. Four hook slots 716 on either side of the center line 708*e* which are adjacent to each other and are spaced apart between the first side 708*a* and the second side 708*b* of the second section 708. The second section also has eight hook notches 718. Four hook notches 718 are on the first side 708*a* of the second section 708 and four hook notches 718 are on the second side of the second section 708. The hook notches 718 are aligned along the same perpendicular axis along the center line as the hook slots 716 with respect to the center line 708*e*. The housing sheet 702 can have a length between 1-100 inches, width between 1-100 inches, and/or a thickness between 0.005-1 inch, or any other length, width, and/or thickness suitable to direct an explosive in a desired direction. In the implementation shown in FIGS. 7-9, the housing sheet 702 has a length of 17.5 inches, a width of 10 inches, and a thickness of 0.25 inches. Although the hooks 714 each curve toward the plane of the second end 706*b* of the first section 706 in the implementation of FIGS. 7-10, in other implementations, the hooks 714 also curve away from the plane of the second end 706*b*.

The lid 717 is a rectangular sheet having a first end 717*a* and a second end 717*b*, a first surface 717*c* and a second surface 717*d*, and two sets of four adjacent hook slots 717*e*. Each set of four adjacent hook slots 717*e* are disposed at opposite ends of the length of the rectangle. Each of the hook slots 717*e* is configured to receive one of the hooks 714 extending from the third end 706*c* of the first section or the fourth end 706*e* of the first section. The lid 717 can have a length between 1-100 inches, a width between 1-100 inches, and/or a thickness between 0.005-1 inch, or any other length, width, and thickness suitable to direct an explosive in a desired direction. In the implementation shown in FIGS. 7-9, the lid 717 has a length of 13.2 inches, a width of 4.2 inches, and a thickness of 0.25 inches.

The system 700 includes support tabs 722 which are disposed into slots on the first section 706 of the housing sheet 702. The support tabs 722 extend into the enclosure and support the weight of a shaped charge liner 704 such that the shaped charge liner 704 securely sits on the support tabs 722 before the system 700 is detonated.

When assembled, the first section 706 of the housing sheet 702 is separated in half along the center line 706*e*. The second section 708 is also separated in half along the center line 708*e*. The first end 706*a* and the second end 706*b* of the first section 706 are aligned such that the first end 706*a* and the second end 706*b* of the first section 706 are co-planar and parallel. The two halves of the second section 708 are each aligned such that one hook 714 on the first end 706*a* and the second end 706*b*, of each half of the first section 706 is coupled to a corresponding hook slot 716. A second hook on the third end 706*c* of each half of the first section is coupled to the notch 718 that the first hook slot 716 is aligned with. When each of the hooks 714, side hooks 715 and hook slots 716 are coupled together, the housing sheet 702 forms a square enclosure. The two halves of the second section 708 are locked into place by locking tabs which are inserted in the locking notches 720 of the first section. The lid 717 is coupled to the hooks 714 on the third end 706*c* and the fourth end 706*d* of the first section 706 and locked into place by the hooks 714.

In some implementations, a portion of the first section 704 and the second section 706 which is disposed to either side of their respective center lines 706*e*, 708*e* forms a stand 724 when the system is assembled. The stand 724 is removable to reduce the size of the base of the system 700 for a desired application requiring a system 700 having no stand 724. In some implementations, the stand is adjustable to accommodate forming a base having a plurality of sizing options when the system 700 is assembled.

Figure 7:
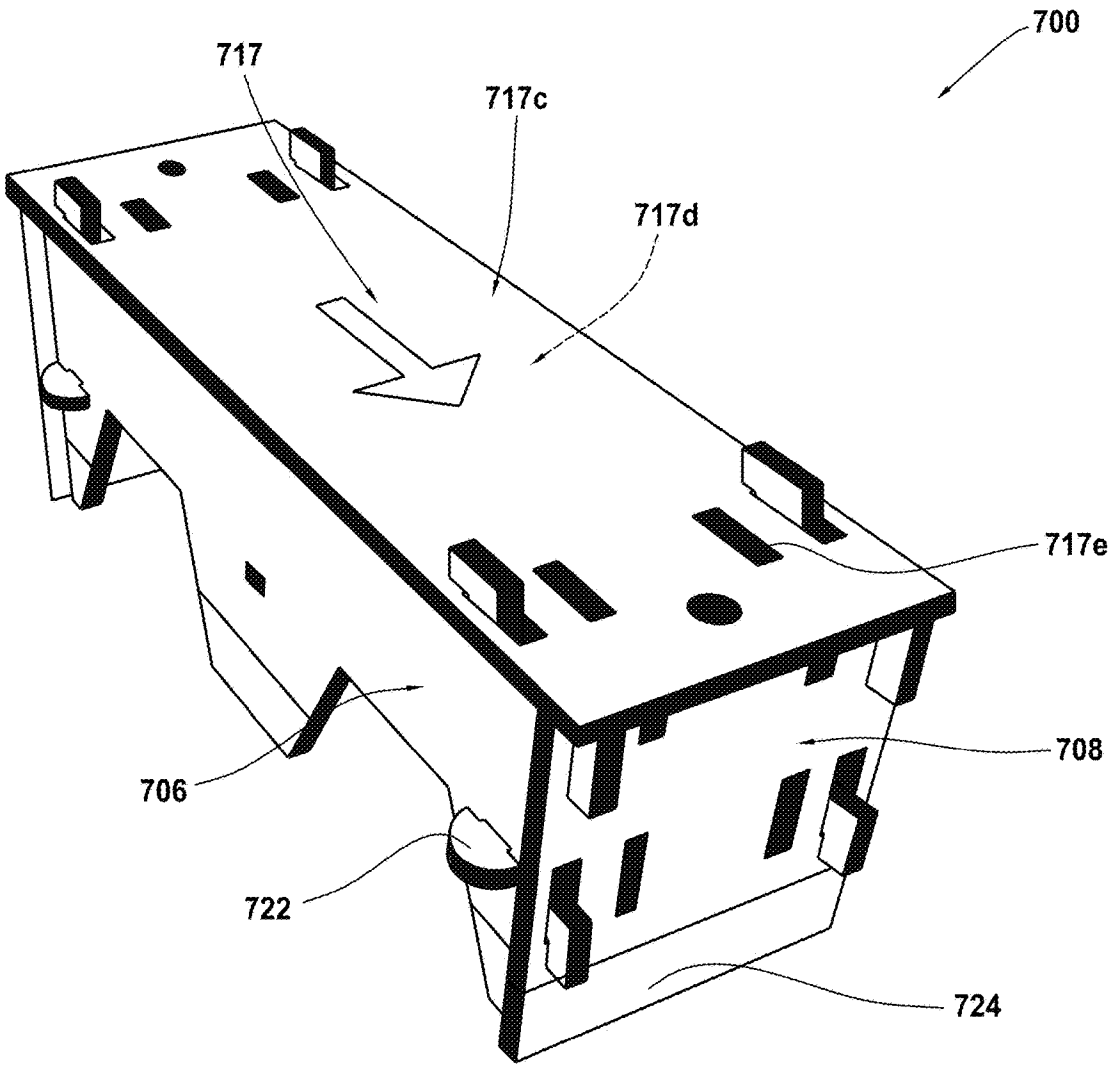
FIG. 7 is a perspective view of a housing sheet forming a shaped charge enclosure, according to another example implementation of the present disclosure.
Figure 8:
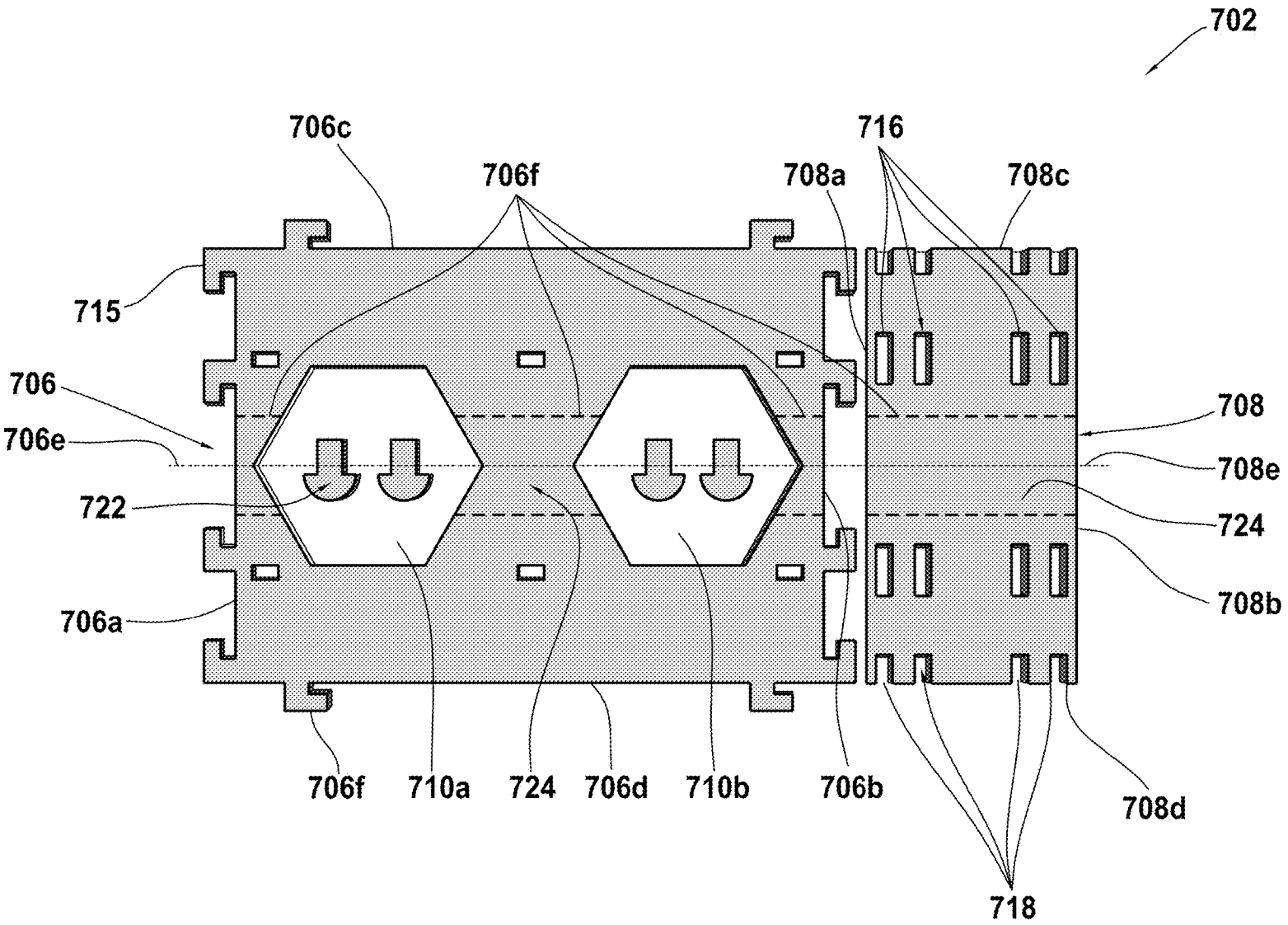
FIG. 8 is a side view of the housing sheet shown in FIG. 7 in unassembled form.
Figure 9B:
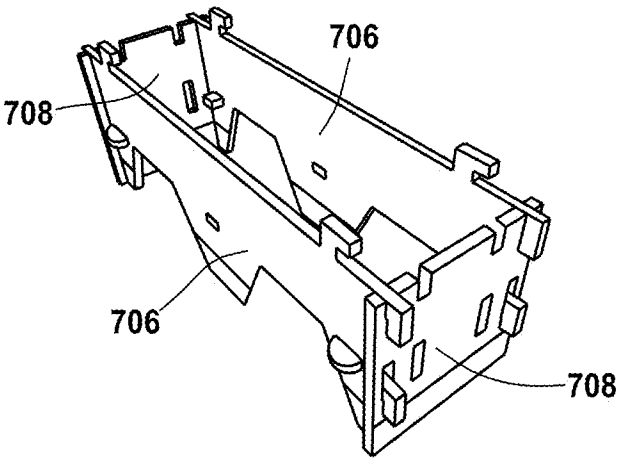
FIG. 9B shows the housing sheet shown in FIG. 7 in a second partially assembled form.
Figure 9C:
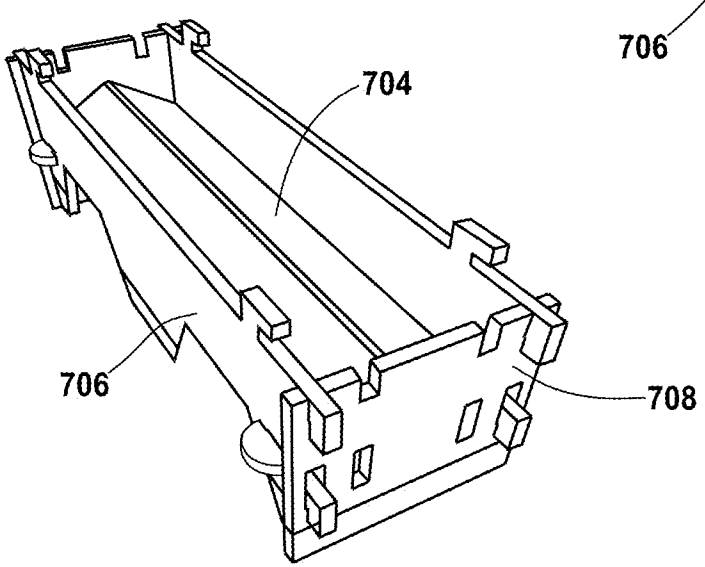
FIG. 9C shows the housing sheet shown in FIG. 7 in a partially assembled form and coupled to a shaped charge liner.
Figure 9A:
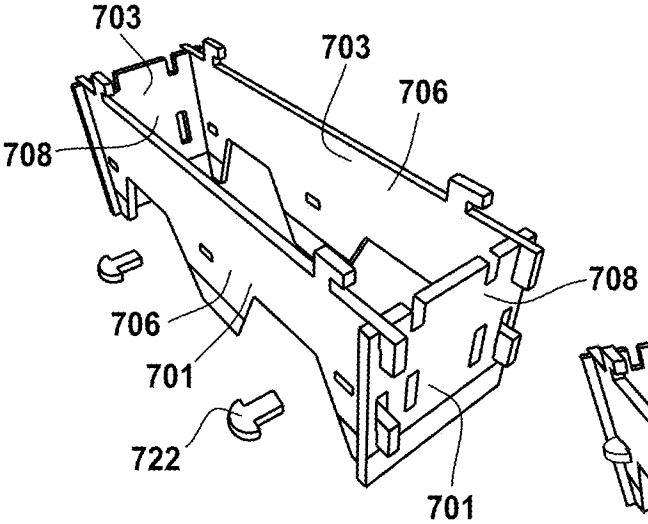
FIG. 9A shows the housing sheet shown in FIG. 7 in partially assembled form.
Figure 10B:
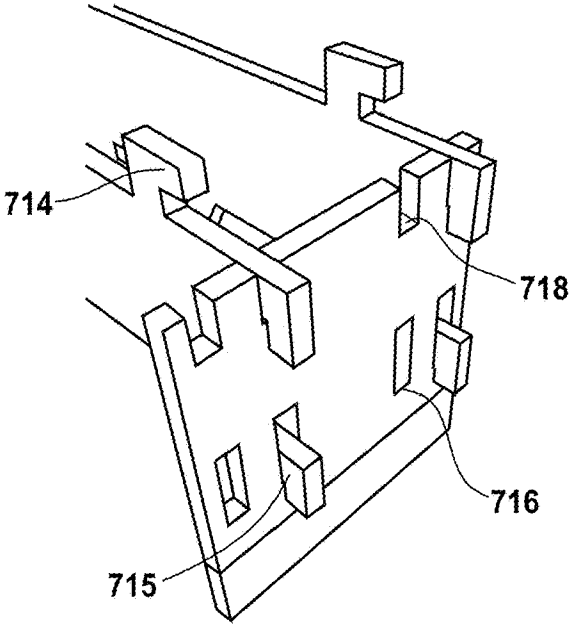
FIG. 10B shows the housing sheet shown in FIG. 7 in a partially assembled form having a second size configuration.
Figure 10C:
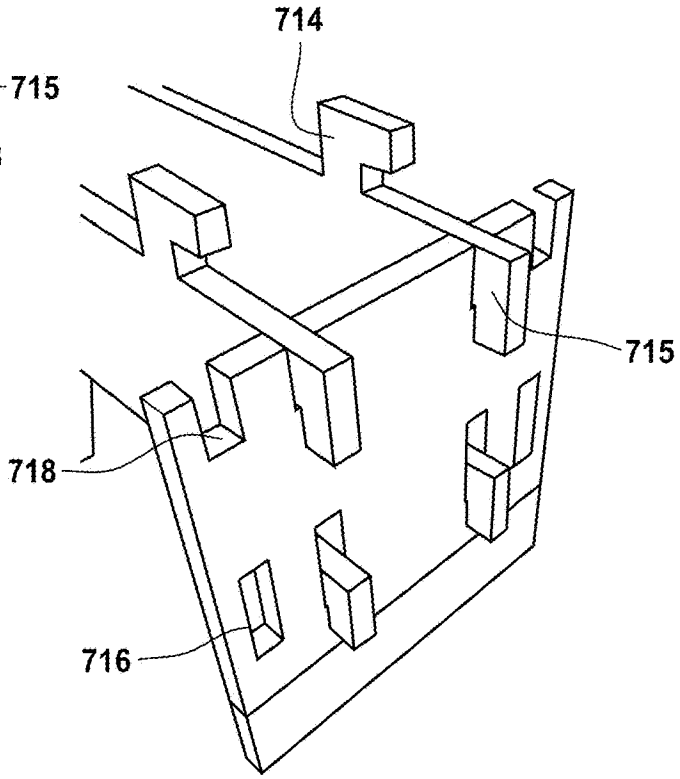
FIG. 10C shows the housing sheet shown in FIG. 7 in a partially assembled form having a third size configuration.
Figure 10A:
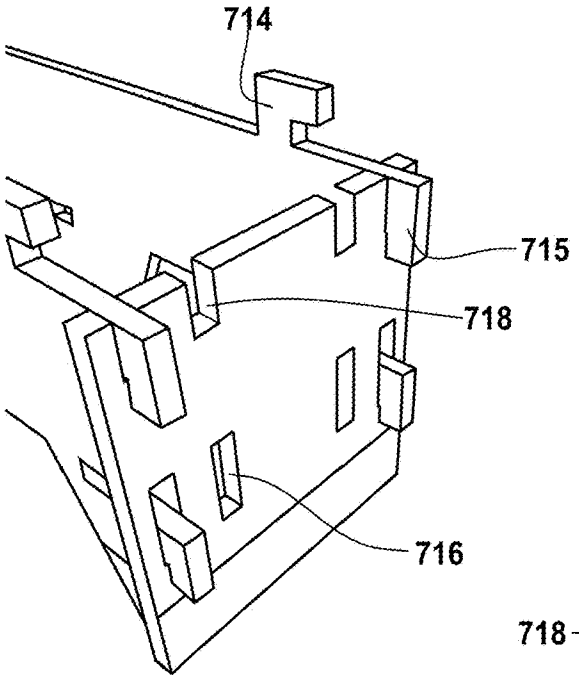
FIG. 10A shows the housing sheet shown in FIG. 7 in a partially assembled form having a first size configuration.

Although a cuboid enclosure is shown, in some implementations (not shown) the housing sheet 702 can be used to form a triangular enclosure, square cube enclosure, or an enclosure having any other shape that is suitable to direct an explosion in a desired direction. Although the housing sheet 702 shown in FIGS. 7-9 is formed from medium density fiber board, in other implementations the housing sheet is formed from aluminum, plastic, composites, or any other material suitable to hold the shaped charge, a detonator, and liner in a desired configuration and orientation to direct an explosion.

The various implementations described above are provided by way of illustration only and should not be construed to limit the scope of the present disclosure. The patentable scope of certain implementations of the present disclosure is indicated by the appended claims, rather than the foregoing description, and all changes that come within the meaning and range of equivalents thereof are intended to be embraced therein.

What is claimed is:

1. A device comprising:

a housing sheet that is configurable to form at least part of a shaped charge enclosure enclosing a shaped charge and biasing an explosion in a desired direction, wherein the housing sheet has a first surface, a second surface opposite and spaced apart from the first surface, a first end extending between the first surface and the second surface, and a second end opposite and spaced apart from the first end, wherein the first surface of the housing sheet defines one or more axial incisions and the second surface of the housing sheet defines a circumferential incision configured to couple to a shaped charge liner, wherein the housing sheet has at least one connection mechanism integrally formed therein for coupling the first end to the second end, is configurable to form a plurality of sizes of shaped charge housing portions, and provides for forming a plurality of dimensions of the shaped charge enclosure.

2. The device of claim 1, wherein the plurality of sizes of shaped charge housing portions defines a plurality of corresponding shaped charge enclosures.

3. The device of claim 1, wherein the axial incisions are configured to increase bendability of the housing sheet at the locations of the axial incisions to form the at least part of the shaped charge enclosure.

4. The device of claim 3, wherein the housing sheet is configurable to form a cylindrical shaped housing portion, and wherein the axial incisions are configured to increase bendability of the housing sheet to form the cylindrical shape.

5. The device of claim 4, wherein the housing sheet further comprises hooks on an end thereof, the hooks being configured to secure a lid to the cylindrical shaped housing portion.

6. The device of claim 4, wherein the housing sheet is configured to form a cylindrically shaped housing portion, wherein the housing sheet defines a plurality of corrugation flutes extending from the first end to the second end of the housing sheet.

7. The device of claim 6, wherein the corrugation flutes comprise locking notches disposed in an outer surface of the housing sheet.

8. The device of claim 4, further comprising auxiliary coupling holes disposed in the at least one surface of the housing sheet.

9. The device of claim 1, wherein the incisions comprise perforations configured to provide separability of the housing sheet into a plurality of particularly defined housing components.

10. The device of claim 9, wherein the housing sheet is configurable to form a shaped charge enclosure having a shaped charge stand, wherein the shaped charge stand is integrally formed with the housing sheet.

11. The device of claim 10, wherein the shaped charge stand is configurable into a plurality of sizes.

12. The device of claim 9, further comprising:

a set of hooks formed in the housing sheet; and a set of hook receivers disposed in the housing sheet, wherein the hooks and the hook receivers are couplable to form a shaped charge enclosure from the housing components when the housing components are in a separated configuration.

13. The device of claim 9, wherein the shaped charge enclosure is configured as a linear enclosure.

14. A shaped charge system, the system comprising:

a housing sheet that is configurable to form at least part of a shaped charge enclosure enclosing a shaped charge and biasing an explosion in a desired direction, wherein the housing sheet has a first surface, a second surface opposite and spaced apart from the first surface, a first end extending between the first surface and the second surface, and a second end opposite and spaced apart from the first end, wherein the first surface of the housing sheet defines one or more axial incisions and the second surface of the housing sheet defines a circumferential incision configured to couple to a shaped charge liner, wherein the housing sheet has at least one connection mechanism integrally formed therein for coupling the first end to the second end, is configurable to form a plurality of sizes of housing portions, and provides for forming a plurality of dimensions of the shaped charge enclosure;

an explosive disposed inside the enclosure of the shaped charge device; and a shaped charge liner coupled to at least one shaped charge housing sheet.

15. The system of claim 14, wherein the shaped charge liner forms part of the shaped charge enclosure.

16. The system of claim 14, wherein the plurality of sizes of housing portions defines a plurality of corresponding shaped charge enclosures.

17. The system of claim 14, wherein the housing sheet forms a cylindrical housing enclosure.

18. The system of claim 17, further comprising a lid having at least one hook slot, wherein the housing sheet further comprises at least one hook on an end thereof, and wherein at least one hook of the housing sheet is coupled to at least one hook slot of the lid.

19. The system of claim 17, wherein at least a portion of the shaped charge liner is lodged in the circumferential incision of the cylindrical housing.

20. The system of claim 19, wherein the housing sheet defines corrugation flutes which extend at least partially through the length of the housing sheet from the first end to the second end of the housing sheet.

21. The system of claim 20, wherein the corrugation flutes have locking notches disposed in the first surface of the housing sheet.

22. The system of claim 20, further comprising at least one joinery having connection tabs, wherein the connection tabs are disposed inside the corrugation flutes.

23. The system of claim 22, wherein the connection tabs are engaged with the corrugation flutes by press fit.

24. The system of claim 22, wherein the connection tabs are engaged with the locking notches.

25. The system of claim 20, further comprising at least one cable tie disposed in at least one of the corrugation flutes.

26. The system of claim 14, wherein the housing sheet and the liner are coupled to form a linear housing.

* * * * *